United States Patent [19]

Hollingsworth

[11] 3,968,542

[45] July 13, 1976

[54] BEATER ROLL

[76] Inventor: John D. Hollingsworth, P.O. Box 516, Greenville, S.C. 29602

[22] Filed: Mar. 21, 1975

[21] Appl. No.: 561,001

[52] U.S. Cl. ..... 19/97; 19/112

[51] Int. Cl.[2] ..... D01G 15/14

[58] Field of Search ..... 19/112, 114, 97, 234, 19/113; 29/121 H

[56] References Cited

UNITED STATES PATENTS

| | | | |
|---|---|---|---|
| 6,579 | 7/1849 | Bailey | 19/97 |
| 425,087 | 4/1890 | Sargent et al. | 19/97 |
| 3,419,941 | 1/1969 | Moriwaki | 19/234 |
| 3,604,062 | 9/1971 | Hollingsworth | 19/113 |

FOREIGN PATENTS OR APPLICATIONS

| | | | |
|---|---|---|---|
| 1,967 | 1878 | United Kingdom | 19/112 |
| 954,591 | 4/1964 | United Kingdom | 19/112 |
| 1,041,500 | 9/1966 | United Kingdom | 19/112 |

*Primary Examiner*—Dorsey Newton
*Attorney, Agent, or Firm*—Bailey & Dority

[57] ABSTRACT

A beater roll for open end spinning is illustrated wherein a coil of metallic wire card clothing has a predetermined set applied therein prior to installation such that the coil assumes an inside diameter less than an outside diameter of a molded plastic drum on which it is installed, the coil being wound in successive contiguous convolutions so that the beater roll is durable, disposable and has a minimized tendency to load with fibers.

2 Claims, 5 Drawing Figures

BEATER ROLL

BACKGROUND OF THE INVENTION

Beater rolls of the general type set forth herein have been used in open end spinning since its inception. Generally, however, such is metallic wire card clothing wound in grooves in a metallic drum for forming the beater roll. The metallic card clothing wires are spaced from each other so that there is a marked tendency toward loading and excessive wear of the beater roll. Once a buildup of fibers commences in the grooves of the drum, such buildup has a tendency to continue in the peripheral areas of the drum between the convolutions of metallic wire card clothing. Such rolls rotate at very high speeds making for a pronounced tendency toward excessive wear of the metallic clothing as well as bearings and drive mechanisms. Reclothing of the rolls is difficult and expensive because they must be sent back to the manufacturer for removal of worn metallic card clothing and for application of new clothing and balancing once the worn clothing has been removed.

While it has been thought necessary or at least more desirable to use groove wound metallic clothing, the increased expense involved in the initial manufacture and maintenance thereof as well as the limited wearing capabilities thereof makes it desirable to provide a beater roll which will last a long time and which may be inexpensively constructed so as to be disposable.

Accordingly, it is an important object of this invention to provide a beater roll which is inexpensive to manufacture so as to be disposable.

Another important object of this invention is to provide a beater roll for use in open end spinning which will minimize the tendency of fibers to load thereon.

Another important object of the invention is to provide a beater roll having improved wear characteristics which is capable of operating at high speeds inherent in open end spinning with a reduced tendency to wear and load.

BRIEF DESCRIPTION OF THE INVENTION

It has been found that by applying a tightly wound coil of metallic wire card clothing, having a set therein so that the coil assumes an inside diameter less than the outside diameter of a molded synthetic beater roll drum prior to being placed thereon, with the convolutions of metallic wire card clothing abutting and preferably sealed by glue, an improved, better wearing beater roll may be provided inexpensively so as to be disposable.

Efforts have been made heretofore to provide a beater roll having surface wound metallic wire card clothing but such requires special preparation of the metallic drum by grooving it to receive the ends of the wire clothing which is wound thereon under tension helically so as to provide lateral spacing between windings of the metallic wire card clothing.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

Figure 1:
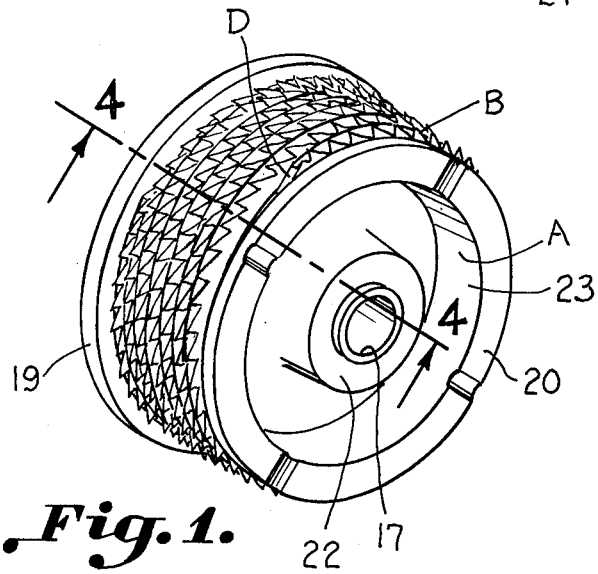
FIG. 1 is a perspective view illustrating a beater roll constructed in accordance with the present invention.

The drawing illustrates a beater roll for use in opening fibers for open end spinning positioned for rotation within an opening chamber for receiving and opening textile fibers and then delivering the opened fibers to a spinning chamber. The beater roll includes a cylindrical drum A constructed of molded synthetic polymeric material having a transverse outwardly extending flange adjacent an end thereof and a longitudinal central opening for mounting the drum for rotation within the opening chamber. A coil of metallic wire card clothing B has a base portion carrying spaced carding teeth extending upwardly therefrom adjacent an edge thereof. A predetermined set is placed in said coil of metallic card clothing prior to applying the clothing to the drum such that in an unstressed state, the coil assumes an inside diameter less than an outside diameter of the drum. The coil is placed upon the drum with successive contiguous convolutions and with such set remaining therein, upon the drum so as to be retained thereon by the stress produced by the set tending to retain the clothing upon the drum. Adhesive means C affixes the coil is fixed position upon a surface of the drum. Thus, a durable disposable beater roll having a minimized tendency to load is provided. A leading edge of the wire card clothing has a tapered surface D extending rearwardly opposite the direction of rotation of the drum.

Figure 5:
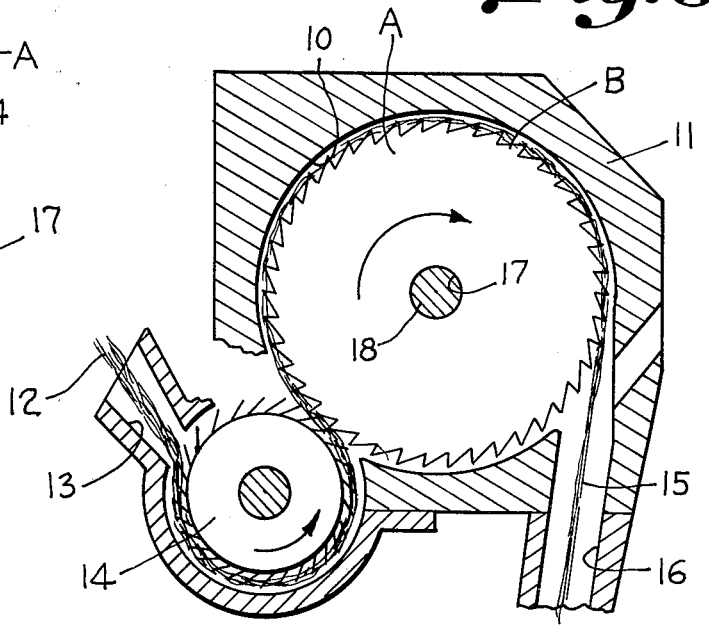
FIG. 5 is a front elevational view, partially in section, illustrating the beater roll within an opening chamber of an open end spinning machine.

Referring especially to FIG. 5, it will be noted that the opening chamber is designated at 10 within a housing of a usual type which is illustrated at 11. The sliver 12 is fed through the passageway 13 by the feed roll 14 which carries the fibers forming the sliver 12 into the opening chamber 10. From the opening chamber 10, the open fibers 15 are fed through the channel 16 to the rotor (not shown). The beater roll includes a drum broadly designated at A having a central bore 17 therein for mounting upon a driven shaft 18 which turns the beater roll in the direction of the arrow in FIG. 5 at high speed within the opening chamber 10.

The cylindrical drum A is preferably constructed of a molded synthetic polymeric material such as styrene. A suitable product is described in Product Information Bulletin No. 1071 of Monsanto Company, St. Louis, Missouri. It will be understood that any disposable plastic or similar material may be used which is not subject to excessive wear and is capable of withstanding the stresses imparted therein as a result of rotation at high speed.

The cylindrical drum A further includes a transverse outwardly extending flange 19 adjacent one end thereof and is illustrated as including another transverse outwardly extending flange 20 adjacent the other end. A smooth cylindrical surface 21 is defined there-between. The axial bore 17 may be carried within a hub 22 defining, together with flange 20, a hollow opening 23 reducing the weight and material necessary for the construction of the drum.

The coil of metallic wire card clothing illustrated at B is first wound upon an arbor to place a set therein so that the coil thus formed has an inside diameter greater than the outside diameter of the drum as illustrated at 21 when the coil is in an unstressed state. During manufacture, the wire card clothing is removed from the arbor and then placed upon the drum so that the set remains therein causing the wire card clothing at all time to exert a constricting action upon the surface 21 of the drum causing the wire to tend to remain firmly and immovably positioned on the drum between the flanges 19 and 20. To place the coil upon the drum, it is desirable to exert opposite twisting forces at the ends of the coil to expand the convolutions against the set, temporarily as the coil is slipped on the drum.

It is important that the coil be first formed and then slipped on the drum. If the wire card clothing is wound on the drum, the end of the coil must be firmly anchored on the drum. This is expensive and time consuming. Moreover, the pretensioned coil tends to maintain its convolutions tightly together.

The wire is illustrated as including a base 24 carrying the usual upstanding teeth 24 adjacent one edge thereof. The base 24 forms a shoulder 26 on the side thereof opposite the upstanding teeth 25. The base 24 also forms a stable cylindrical base portion 27 for reception by the cylindrical surface 21 of the drum A.

It will be noted that the coil is further fastened to the cylindrical drum A as by suitable adhesive means C which may be placed upon the surface 21 prior to applying the metallic card clothing thereto so as to extend beneath the base portion 27 of the coil and between successive contiguous windings of the coil and extending slightly outwardly therefrom so as to seal any opening as may appear between successive contiguous convolutions of the wire card clothing.

Figure 2:
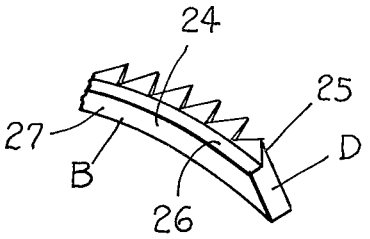
FIG. 2 is an enlarged, perspective view illustrating a leading end of the metallic wire illustrated in FIG, 1.
Figure 3:
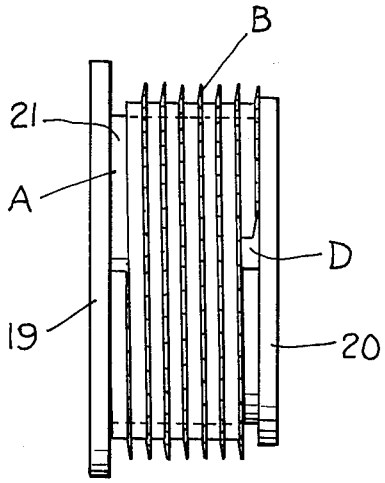
FIG. 3 is a side elevation further illustrating the beater roll.
Figure 4:
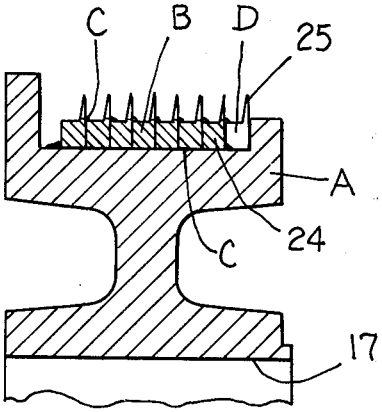
FIG. 4 is a longitudinal sectional elevation taken on the line 4—4 in FIG. 1.

Referring especially to FIGS. 1, 2 and 3, it will be noted that the leading edge of the wire is tapered forwardly as illustrated at D. Thus, there will be a lessening of the tendency of the leading edge to be separated from the drum as when it engages fibrous masses at high speed within the opening chamber of an open end spinning machine. It will be observed that the tendency of the metallic wire card clothing to remain in fixed position as a result of the set applied thereto is augmentated by the glue which serves the function of insuring that the wire remains immovably fixed upon the cylindrical drum as well as sealing the space as may occur between the convolutions of wire card clothing.

Thus, a long lasting disposable beater roll has been provided susceptible to manufacture at low cost for imparting disposability to the product. A superior beater roll has been provided because it will not load and is highly wear resistant. A high concentration of teeth may be applied to the clothing enhancing its capabilities for opening fibers. Since the beater roll will not load, there is less danger of damage thereto further prolonging the wearing characteristics of the wire metallic card clothing.

While a preferred embodiment of the invention has been described using specific terms, such description is for illustrative purposes only, and it is to be understood that changes and variations may be made without departing from the spirit or scope of the following claims.

What is claimed is:

1. A beater roll for opening fibers comprising:

a cylindrical drum constructed of molded synthetic polymeric material having a longitudinal central opening for mounting the drum for rotation;

a coil of preset metallic wire card clothing having a base portion carrying spaced carding teeth extending upwardly therefrom adjacent an edge thereof with a predetermined set in said coil of metallic card clothing such that in an unstressed state, the coil would assume an inside diameter less than an outside diameter of the drum;

said coil having successive contiguous convolutions and with such set remaining therein, upon the drum so as to aid in retaining the coil thereon by the compressive stresses produced by the set causing the clothing to bear and exert constrictive force upon the drum so as to grip the drum; and adhesive means extending between said wire card clothing and said surface of the drum as well as between said contiguous convolutions.

2. The structure set forth in claim 1, wherein a leading edge of said wire card clothing is tapered upwardly rearwardly opposite a direction of rotation of the drum.

* * * * *